United States Patent [19]

Horn

[11] 4,167,716

[45] Sep. 11, 1979

[54] CONTROLLED SWITCHING APPARATUS

[75] Inventor: John Horn, Philadelphia, Pa.

[73] Assignee: Gould Inc., Rolling Meadows, Ill.

[21] Appl. No.: 893,206

[22] Filed: Apr. 3, 1978

[51] Int. Cl.[2] ..... H01H 75/00; H01H 77/00

[52] U.S. Cl. ..... 335/14; 335/8; 335/20

[58] Field of Search ..... 335/20, 8, 9, 10, 14; 307/38, 39, 40; 219/327

[56] References Cited

U.S. PATENT DOCUMENTS

| | | | |
|---|---|---|---|
| 3,369,202 | 2/1968 | Gryctko | 335/20 |
| 3,906,413 | 9/1975 | Clausing | 335/14 |

*Primary Examiner*—Harold Broome

*Attorney, Agent, or Firm*—Ostrolenk, Faber, Gerb & Soffen

[57] ABSTRACT

Controlled switching apparatus mountable in a conventional residential panelboard includes a conventional molded case circuit breaker module mounted in adjacent side-by-side relation with an operator module. The latter is remotely operated and includes a single remotely operated electrically energized unidirectional actuator which oscillates a rocker connected to the circuit breaker handle for selective movement thereof between its On and Off positions.

10 Claims, 8 Drawing Figures

CONTROLLED SWITCHING APPARATUS

Notwithstanding sharply rising costs for producing electrical energy the demand for electricity continues to increase. This demand often exceeds existing capacity. On occasion, excessive demand has caused generating system breakdowns resulting in complete de-energization of large blocks of consumers. In other instances, excess demand has been handled by reducing voltage. This is unsatisfactory to consumers having equipment which functions poorly or ceases to function in the absence of full voltage availability.

In order to obviate the necessity for expanding the capacity for generating electrical energy to meet peak demands of relatively duration, it has been proposed that the power generating companies be provided with the capability of load management independently of control by the customers. That is, equipment is provided which enables the power company to de-energize selected loads of certain customers without interrupting electrical service to more critical loads. Typically, the load that is interrupted during high demand periods is a non-critical home appliance such as an electric water heater or an air conditioner.

Pursuant to the instant invention the foregoing is achieved using minimal change in existing residential electrical equipment. That is, of a conventional plug-in type residential panelboard is utilized together with a conventional narrow molded case circuit breaker module to which an operator module has been added. These modules are of substantially the same size and are mounted side-by-side with external handles thereof being tied together for simultaneous operation whereby the circuit breaker contacts may be opened and closed by operation of the operator module.

The latter includes a single repositionable actuator to selectively open and close the circuit breaker. The actuator is a unidirectional device having a spring return and is electrically energized by signals generated by the utility company at a location remote from the panelboard. Typically, the actuator is a solenoid, a pneumatic device, a hydraulic device, but preferably a thermal-fluid actuator.

Accordingly, the primary object of the instant invention is to provide novel controlled switching apparatus for management of electrical loads from a location remote from the load.

Another object is to provide novel controlled switching apparatus which is readily mountable in conventional panelboards at locations designated for conventional residential circuit breakers.

Still another object is to provide controlled switching apparatus of this type which includes a single unidirectional power actuator which is automatically repositioned to effect oscillatory action of a rocker connected to operate a circuit breaker both On and Off.

A further object is to provide controlled switching apparatus of this type which includes a remotely controlled linear power actuator for opening and closing a circuit breaker by direct transmission of mechanical force to the latter.

These objects as well as other objects of this invention shall become readily apparent after reading the following description of the accompanying drawings in which.

Figure 2:
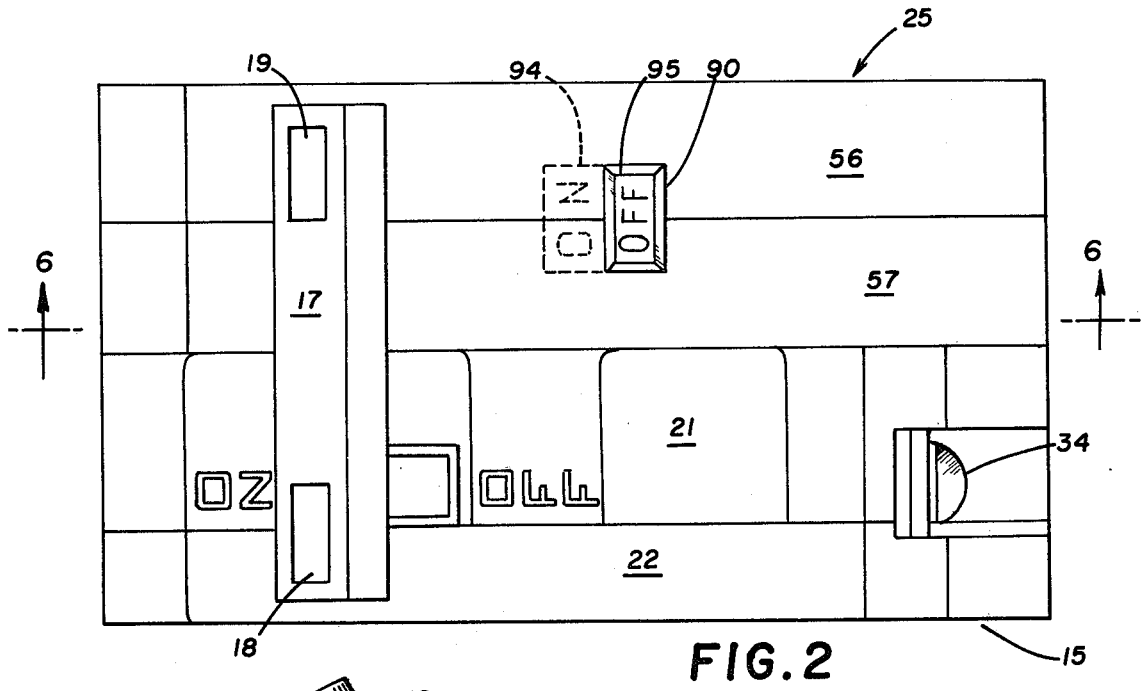
FIG. 2 is an enlarged plan view looking in the direction of arrows 2—2 of FIG. 1.
Figure 6:
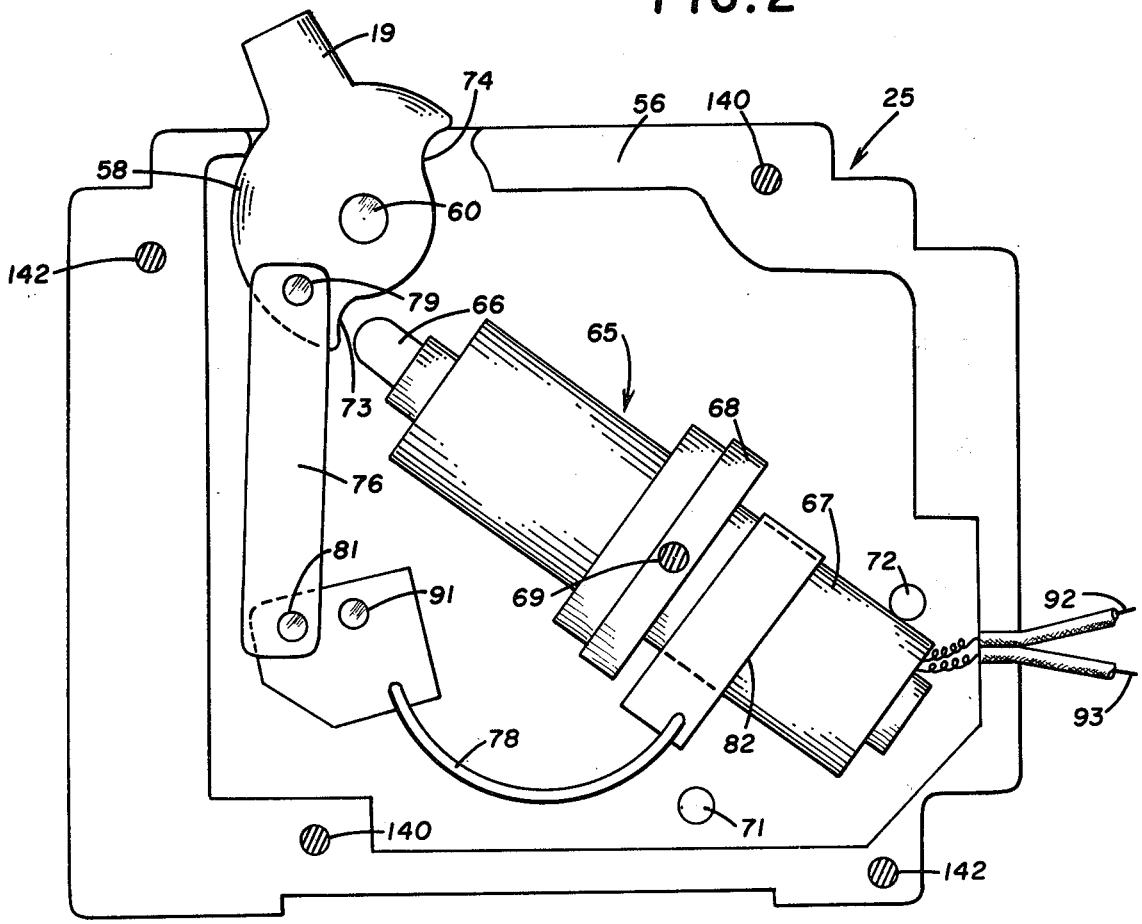
Figure 7:
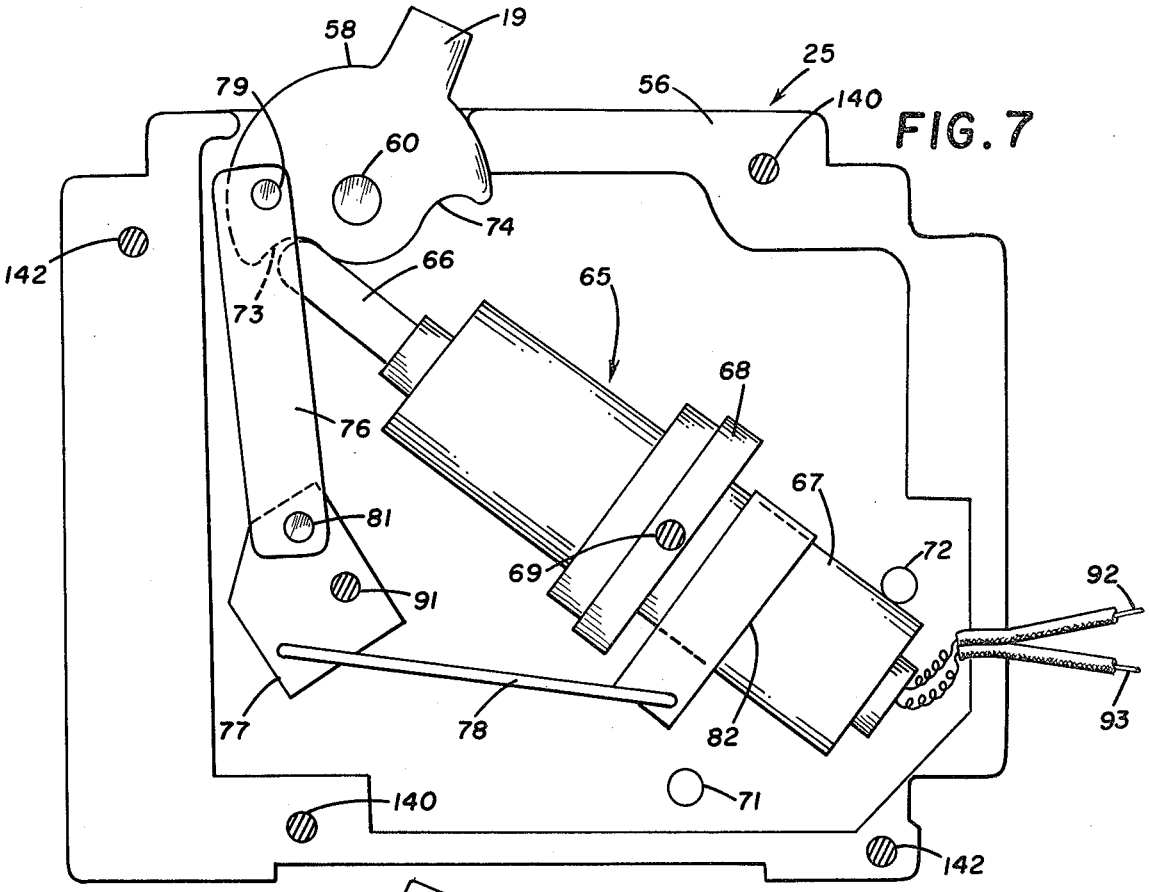
Figure 8:
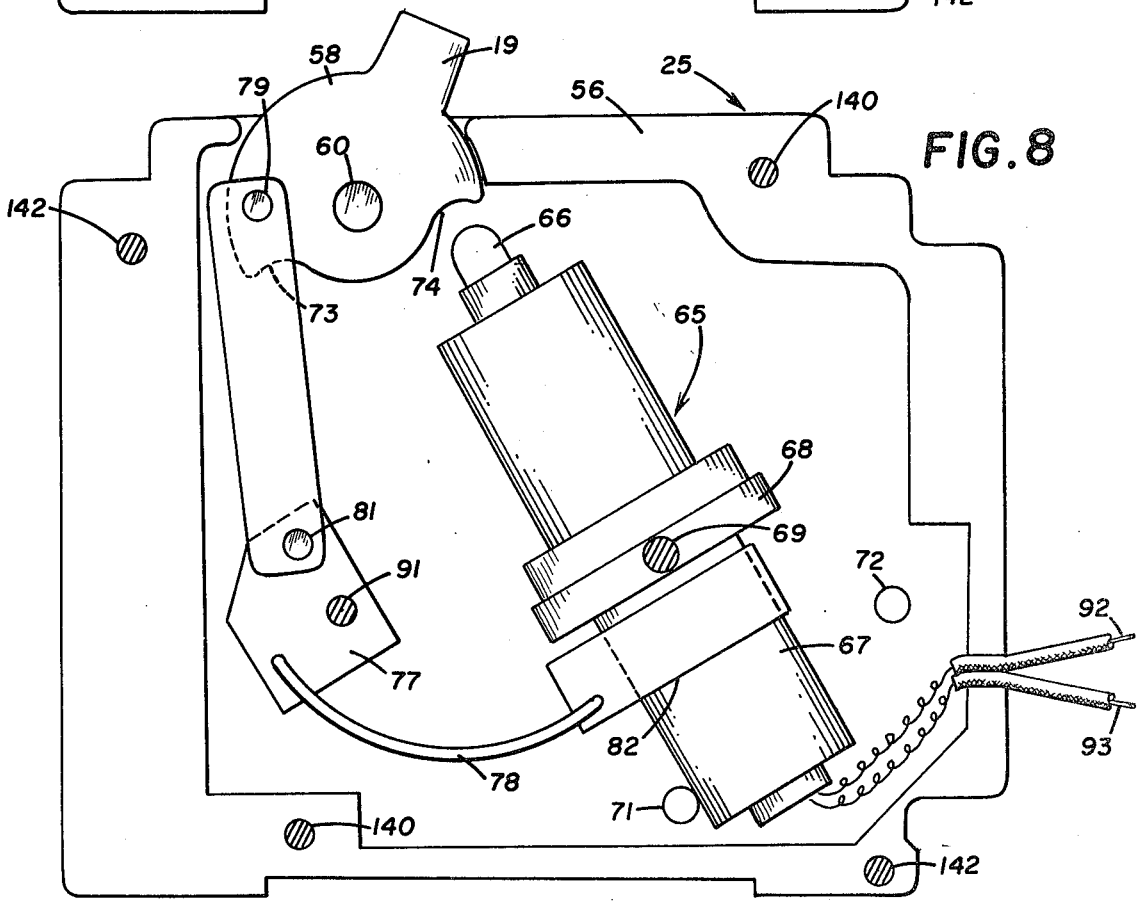

FIGS. 6 through 8 are enlarged side elevations looking in the direction of arrows 6—6 of FIG. 2 showing the operator section with its cover removed to reveal the operating elements thereof. In FIG. 6 the circuit breaker section is closed and the actuator of the operator section is positioned in ready position to open the former, in FIG. 7 the circuit breaker section is open and the actuator of the operator section is positioned with its plunger fully extended in the On power stroke, and in FIG. 8 the circuit breaker section is also open but the actuator of the operator section is in ready position to close the former.

Figure 3:
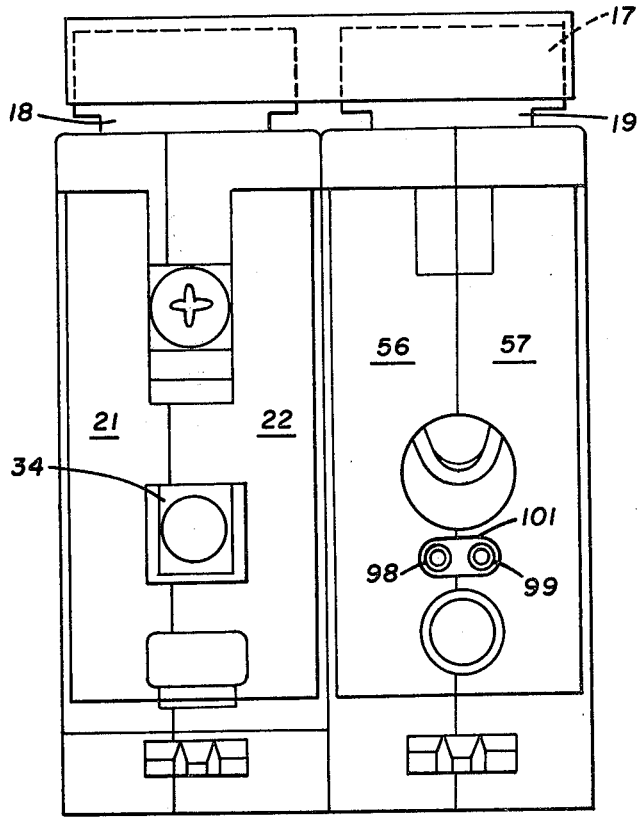
FIG. 3 is a load end view looking in the direction of arrows 3—3 of FIG. 1.
Figure 4:
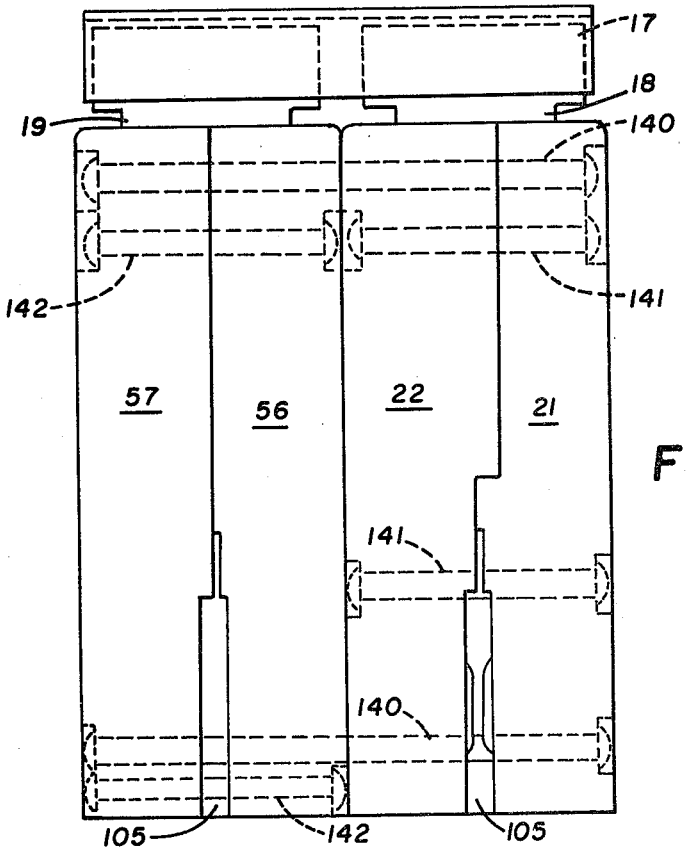
FIG. 4 is a line end view looking in the direction of arrows 4—4 of FIG. 1.

Now referring to the Figures. Controlled switching apparatus 20 is illustrated in FIG. 2 as a single pole unit, consisting of manually operable circuit breaker section 15 mounted in adjacent side-by-side relation remotely controlled operator section 25 by two rivets 140, 140. Handles 18, 19 of respective sections 15, 25 are mechanically tied together by cap member 17. As seen best in FIGS. 2, 3 and 4, each of the sections 15 and 25 is of substantially the same width and each constitutes a module. In a practical embodiment each module is one inch wide. Modules 15 and 25 have similar profile outlines.

Module 15 is a conventional single pole molded case circuit breaker having a one inch wide housing consisting of base 21 and cover 22 held together by rivets 141, 141 and cooperating to enclose and position the operating elements. The current path through switching module 15 extends from line terminal member 26, stationary contact 27, movable contact 28, movable contact arm 29, flexible conductor 31, bimetal 32 and deformable load terminal strap 33 which terminates in wire grip 34. Manual operating handle 18 is at the forward end of operating member 36 which is mounted on stationary pivot 37. The upper end 38 of movable contact arm 29 is pivotally supported at the lower end of operating member 36, being biased thereagainst by main operating spring 39. The latter is a coiled tension member having its lower end 41 connected to contact arm 29 and its upper end 42 connected to releasable cradle 44 at notch 43 in the forward edge thereof at a point intermediate cradle pivot 46 and latching tip 47.

Figure 1:
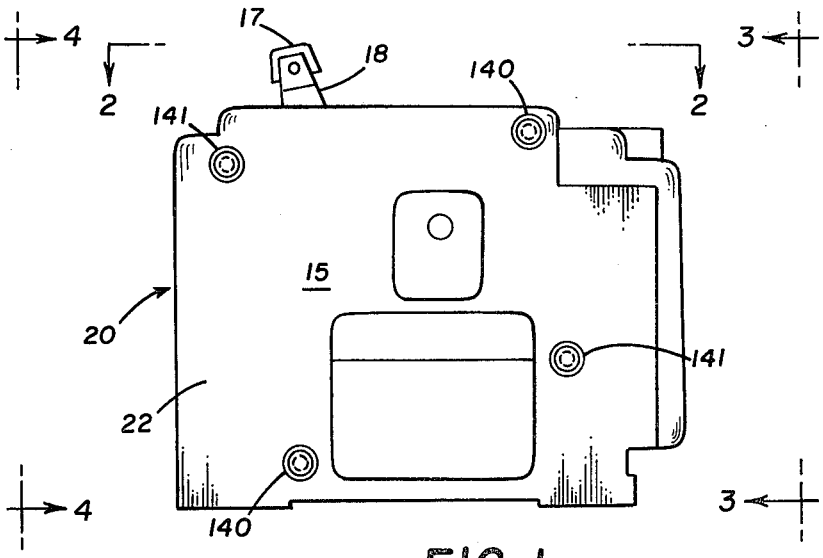
FIG. 1 is a side elevation, looking in the direction of arrows 1—1 of FIG. 2, showing controlled switching apparatus constructed in accordance with teachings of the instant invention.
Figure 5:
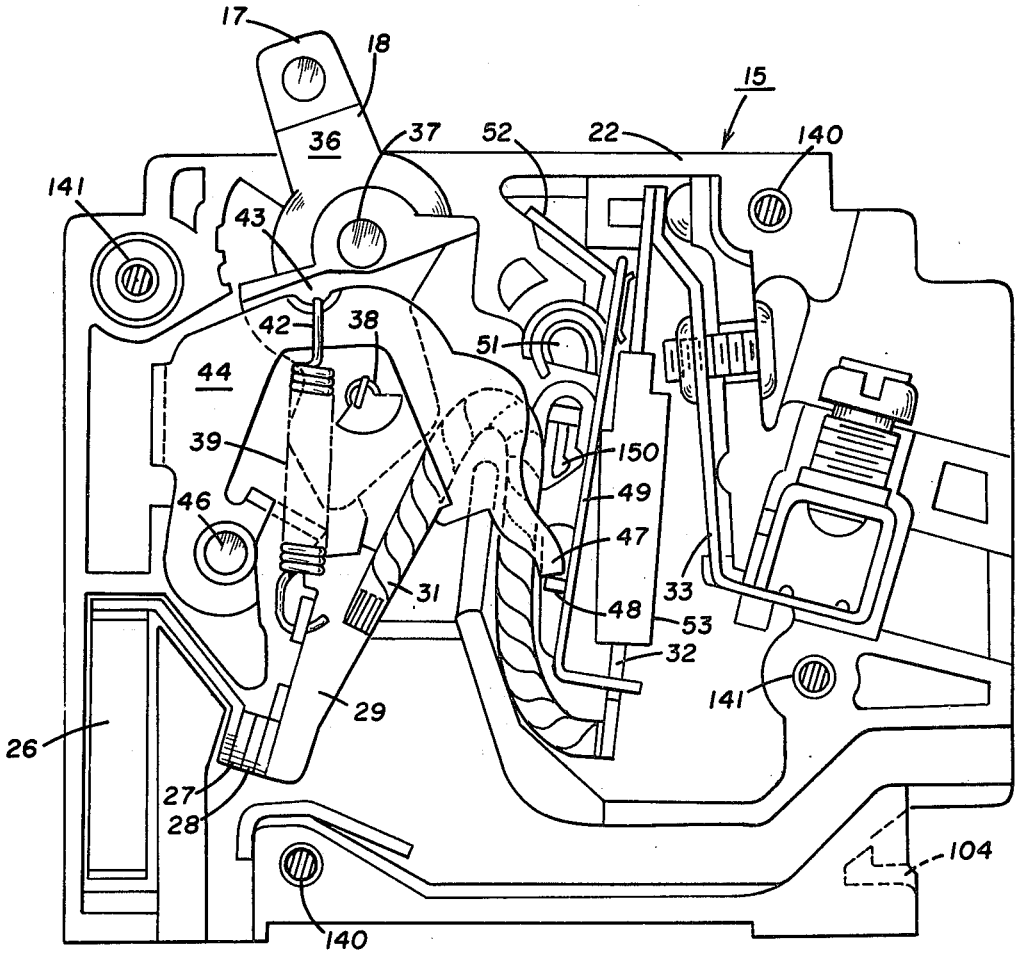
FIG. 5 is an enlarged side elevation of the circuit breaker section looking in the direction of arrows 5—5 of FIG. 2 with the cover of the circuit breaker section removed so as to reveal the operating elements thereof.

When tip 47 supports latch extension 48 of latch member 49, the contact operating mechanism in the reset position shown in FIG. 5. The upper end of latch member 49 is mounted to pivot formation 51 and the lower end of member 49 is offset and provided with a notch through which the lower end of bimetal 32 extends. Wire spring 52 engages the forward end of member 49 biasing the latter toward the latching position shown in FIG. 5. Member 49 constitutes a magnetic armature which is attracted to U-shaped yoke 53 under predetermined overload current conditions. Bimetal 32 extends between the arms of yoke 53 to provide a single energizing turn. As bimetal 32 heats the rear or lower end thereof moves to the right with respect to FIG. 5 causing latch member 49 to pivot counterclockwise so that latch support 48 releases cradle 44. This repositions the line of action of spring 39 so that the latter pivots movable contact arm 29 counterclockwise thereby separating movable contact 28 from stationary contact 27.

Management module 25 includes a molded insulated housing consisting of base 56 and cover 57 held together by rivets 142, 142. As seen in FIGS. 6–8, handle 19 of operator section 25 is a radial extension of rocker 58 which is pivotally mounted on stationary axis 60 so that handle 19 may be moved between the ON position of FIG. 6 and the OFF position of FIG. 7. Rocker pivot 60 and operating member pivot 37 are coaxial and extend parallel to the longitudinal axis of cap 17 which ties handles 18 and 19 together. As will hereinafter be seen, rocker 58 is operated by power actuator 65 which includes axial plunger 66 that is extended (see FIG. 7) relatively rapidly on the power stroke and is retracted to the position of FIGS. 6 and 8 relatively slowly by a return spring (not shown).

Actuator 65 is preferably a thermal-fluid device, sometimes called an electro-thermal pneumatic/hydraulic device, which provides direct conversion of an electrical signal to a relatively large linear force. More particularly, in actuator 65 electrical energy is used to heat a fluid to effect a change in phase of the fluid from liquid to gas, and then the gas pressure is converted to motion by utilizing a piston-cylinder arrangement. A suitable thermal-fluid actuator has been marketed by the Actuator Systems Division of Gould, Inc. in Willoughby, Ohio, U.S.A.

Body 67 of actuator 65 is of round cross-section and includes enlarged portion 68 having diametrically opposed pivot pins 69, 69 (only one of which is shown) extending outwardly therefrom into aligned fixed bearing depressions (not shown) in the interior walls of housing 56, 57. Thus, actuator 65 is pivotally mounted on a fixed axis defined by pins 69. Spaced stops 71, 72 formed in housing 56, 57 are positioned to engage body 67 near its rear end. Plunger 66 extends from the forward end of body 67 and is provided with a rounded free end which, as will hereinafter be seen, engages arcuate surfaces of rocker 58 defining depressions 73, 74.

In order to operatively position actuator 65 for engagement of plunger 66 with the proper surface 73, 74 an automatic positioning means is provided. The latter consists of rigid link 76, crank 77 and resilient link 78. One end of link 76 is pivotally connected to rocker 58 by pin 79 and the other end of link 76 is pivotally connected to crank 77 by pin 81. Crank 77 is pivotally mounted on fixed axis 91. Resilient link 78 is an arcuate wire spring whose ends are hooked to extend through receiving apertures in crank 77 and collar 82 which surrounds body 67 to the rear of pivot 69.

With the elements of operator section 25 in the ON position of FIG. 6, flexible link 78 drives actuator 65 counterclockwise limited by engagement of body 67 with stop 72. In this position of actuator 65, electrical energization thereof by a signal applied across insulated leads 92, 93 drives plunger 66 forward against rocker surface 73 causing clockwise movement of rocker 58 so that extension 19 thereof moves to the OFF position shown in FIG. 7. In moving between its positions of FIGS. 6 and 7, rocker extension 19 acting through tie cap 17 drives circuit breaker section 15 from the ON position shown in FIG. 5 to the OFF position thereof.

With plunger 66 in the extended OFF position of FIG. 7 resilient link 78 is stretched in that the engagement between plunger 66 and rocker 58 prevents clockwise pivoting of actuator 65. However, when actuator 65 is de-energized plunger 66 retracts to the rear of rocker 58 and permits resilient link 78 to assume its normal arcuate position shown in FIG. 8. In moving from the position of FIG. 7 to that of FIG. 8, link 78 pulls actuator 65 clockwise about its pivot 69 until body 67 engages stop 71. In this position plunger 66 is aligned with depression 74 so that the next energization of actuator 65 will drive plunger 66 against rocker 58 at depression 74 to pivot rocker 58 back to the ON position of FIG. 6. While this operation takes place link 78 flexes permitting the ends thereof to move toward one another. Upon subsequent de-energization of actuator 65 plunger 66 retracts, and when the free end thereof moves to the rear of rocker 58 spring link 78 is effective to push actuator 65 counterclockwise to the position wherein body 67 engages stop 72 (FIG. 6).

It should now be apparent that when plunger 66 is fully extended rocker 58 is locked in position and in turn circuit breaker handle 36 is also locked in position. This is particularly useful when switching apparatus 20 is utilized in a load management system. That is, the control signals for operating module 25 are generated by the electric utility company. When the utility switches apparatus 20 to the OFF position, customer override should be prevented. This is done by maintaining plunger 66 extended as in FIG. 7 wherein rocker 58 is in the OFF position and plunger 66 blocks movement of rocker 58 to the ON position.

It is not likely that plunger 66 will be maintained in its extended position when rocker 58 is in the ON position in that the customer homeowner should have the capability of turning apparatus 20 Off. With plunger 66 retracted, force exerted by main spring 39 of circuit breaker module 15 determines the position of rocker 58. In particular, when circuit breaker 15 is tripped rocker handle 19 is in a position intermediate those of FIGS. 6 and 7 and body 67 is spaced from both stops 71 and 72 so that when actuator 65 is energized the line of action for plunger 66 extends through rocker pivot 60 and no turning influence is exerted on rocker 58 by actuator 65.

Now, it should also be apparent to those skilled in the art that for a sophisticated load management system auxiliary switches should be provided to signal the utility's control center as to the state of apparatus 20 so that switching signals will be transmitted to module 25 only under appropriate conditions.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. Controlled switching apparatus including a circuit breaker section and a remotely controllable operator section; said circuit breaker section including a set of cooperating contacts, trip-free spring powered operating means operatively connected to said contacts, said operating means including a manually movable operating member for selectively opening and closing said contacts, said operating member being oscillatable about a first fixed pivot as a center, fault responsive trip means operatively connected to said operating means for automatic activation thereof to open said contacts upon the occurence of predetermined fault conditions; said operator section including a rocker mounted on a second fixed pivot, a single remotely operated electrically energized unidirectional actuator operatively connected to said rocker to oscillate the latter about said second pivot as a center; said first and second pivots being axially aligned; and connecting means joining said operating member to said rocker for simultaneous operation whereby motion of said rocker controlled by actuation of said actuator is effective to move said operating member for both opening and closing said contacts.

2. Controlled switching apparatus as set forth in claim 1 in which the operator section also includes positioning means interposed between said rocker and said actuator to move the latter to first and second positions when said rocker is in respective third and fourth positions; said operating member being in contact open and closed positions when the rocker is in said third and fourth positions, respectively.

3. Controlled switching apparatus as set forth in claim 2 in which the actuator moves between the first and second positions on a third fixed pivot; said actuator including a normally retracted plunger mounted for axial movement in a power stroke to drive said rocker upon actuation of said actuator; with said actuator in said first position axial movement of said plunger in said power stroke being directed on one side of a line extending through said second and third pivots and with said actuator in said second position axial movement of said plunger in said power stroke being directed on the other side of said line.

4. Controlled switching apparatus as set forth in claim 3 in which the positioning means includes a crank pivotally mounted on a fourth fixed pivot, a first link connecting said crank to said rocker and a second link connecting said crank to said actuator at a point remote from said third pivot.

5. Controlled switching apparatus as set forth in claim 4 in which the second link includes a spring means.

6. Controlled switching apparatus as set forth in claim 5 in which the spring means includes a resilient wire member having end portions movable away from one another with respect to their normal relative positions.

7. Controlled switching apparatus as set forth in claim 3 in which the plunger includes a free end portion which makes direct driving engagement with said rocker during said power stroke.

8. Controlled switching apparatus as set forth in claim 7 in which the free end portion of the plunger is disengaged from said rocker when said plunger is retracted.

9. Controlled switching apparatus as set forth in claim 1 in which the actuator includes a normally retracted plunger mounted for axial movement in a power stroke upon actuation of said actuator.

10. Controlled switching apparatus as set forth in claim 9 in which the actuator is comprised of a fluid-thermal device which is electrically energized.

* * * * *